US005839786A

United States Patent [19]

Cvek

[11] Patent Number: 5,839,786

[45] Date of Patent: Nov. 24, 1998

[54] ADJUSTABLE ARMREST

[75] Inventor: Sava M. Cvek, Cambridge, Mass.

[73] Assignee: Stylex, Inc., Delanco, N.J.

[21] Appl. No.: 870,970

[22] Filed: Jun. 6, 1997

[51] Int. Cl.[6] ..... A47C 7/54

[52] U.S. Cl. ..... 297/411.35; 297/411.36; 297/411.37

[58] Field of Search ..... 297/411.35, 411.24, 297/411.31, 411.32, 411.36, 411.37

[56] References Cited

U.S. PATENT DOCUMENTS

| | | | |
|---|---|---|---|
| 4,277,102 | 7/1981 | Aaras et al. . | |
| 4,639,039 | 1/1987 | Donovan . | |
| 4,749,230 | 6/1988 | Tornero . | |
| 4,884,846 | 12/1989 | Tobler . | |
| 4,951,995 | 8/1990 | Teppo et al. . | |
| 5,037,158 | 8/1991 | Crawford . | |
| 5,143,422 | 9/1992 | Althofer et al. . | |
| 5,265,938 | 11/1993 | Melhuish et al. . | |
| 5,286,088 | 2/1994 | Taylor et al. . | |
| 5,318,347 | 6/1994 | Tseng . | |
| 5,324,096 | 6/1994 | Schultz | 297/411.36 |
| 5,338,133 | 8/1994 | Tornero | 297/411.37 X |
| 5,368,365 | 11/1994 | Feldberg | 297/411.36 |
| 5,369,805 | 12/1994 | Bergsten et al. . | |
| 5,382,079 | 1/1995 | Wilson et al. | 297/411.35 X |
| 5,388,892 | 2/1995 | Tornero | 297/411.36 |
| 5,393,124 | 2/1995 | Neil | 297/411.36 X |
| 5,393,125 | 2/1995 | Watson . | |
| 5,407,249 | 4/1995 | Bonutti | 297/411.35 |
| 5,415,459 | 5/1995 | Schultz | 297/411.37 |
| 5,435,626 | 7/1995 | Lai | 297/411.36 |
| 5,439,267 | 8/1995 | Peterson et al. . | |
| 5,439,268 | 8/1995 | Dozsa-Farkas | 297/411.35 |
| 5,484,187 | 1/1996 | Doerner et al. . | |
| 5,536,070 | 7/1996 | Lemmen . | |
| 5,571,274 | 11/1996 | Holstensson . | |
| 5,586,811 | 12/1996 | Tornero . | |
| 5,588,766 | 12/1996 | Lai | 297/411.36 X |
| 5,590,934 | 1/1997 | Gibbs | 297/441.35 X |
| 5,597,204 | 1/1997 | Karaus, Jr. . | |
| 5,597,207 | 1/1997 | Bergsten et al. . | |
| 5,597,208 | 1/1997 | Bonutti . | |
| 5,599,067 | 2/1997 | Schulke et al. | 297/411.37 X |
| 5,620,233 | 4/1997 | Corwin | 297/411.36 |
| 5,641,203 | 6/1997 | Van De Riet et al. | 297/411.37 |
| 5,649,741 | 7/1997 | Beggs | 297/411.36 X |
| 5,660,442 | 8/1997 | Turnero | 297/411.36 |
| 5,664,842 | 9/1997 | Tseng | 297/411.36 |

*Primary Examiner*—Jose V. Chen
*Assistant Examiner*—Rodney B. White
*Attorney, Agent, or Firm*—Stuart E. Beck

[57] ABSTRACT

An armrest to be connected to a chair. The armrest can be moved laterally so that the chair can accommodate people of different body widths. The armrest can be pivoted through a plurality of locations in a plane that is generally parallel to the seat of the chair to support the forearm of the person sitting. Additionally, the armrest can be raised and lowered to accommodate both tall and short people since their elbows are respectively further from and closer to the seat.

23 Claims, 5 Drawing Sheets

ADJUSTABLE ARMREST

FIELD OF THE INVENTION

This invention relates to an adjustable armrest for a chair and more particularly, to an armrest which can be adjusted to comfortably fit persons of different body sizes.

BACKGROUND OF THE INVENTION

For the most part, arm chairs are offered for sale on a "one size fits all" and a "one size is good for all purposes" basis. Thus, persons who need or desire to work in an environment where their forearms are supported are required to sit at chairs where the armrests may be too close or too far from each other for the persons body width, or they may be too high or too low for the persons height.

Also while the armrests may be properly positioned for a particular task or work surface height, when the person moves to a different task or a work surface having a different height than that for which the armrests are set, the armrests may not be properly positioned to provide proper support for the forearms.

For the most part the people who confront this problem on a daily basis are secretaries, computer operators, assemblers, writers, data entry clerks, and other persons who want or need a chair with an arm rest for proper support.

A failure to have such support my result in fatigue or injury. To some extent this problem has been addressed by making the height of chair backs and seats adjustable. Also some manufacturers may provide arms that are customized to the particular person who will be using the chair. However, such customizing is expensive. Further, only the particular person for whom the chair is designed can comfortably use it.

As a consequence of the failure to provide a simple and inexpensive means for adjusting the distance between the armrests and their height, many people are forced to sit and work in chairs that do not properly fit them or which are not suitable for the task they are performing or the surface at which they are working.

Thus, persons whose bodies are relatively wide, either because they are heavy or because they carry equipment around their waist, such as policemen and the like, often find it difficult to get in and out of chairs because the arms are too close to each other.

Further, if a chair with armrests positioned to accommodate a person having a wide body or to accommodate a person who carries equipment around their waist is used by a slim person, to use the armrests they must turn their forearms inwardly to an uncomfortable position to bring their hands in front of their body.

On the other hand, while a tall person can raise the seat and back to accommodate their leg length and height, there is little that they can to raise the armrests to a comfortable level.

Similarly, persons who are short can also adjust the seat and back to a level which is comfortable. However, an inability to adjust the height of the armrests means that these persons, if they choose to use the arms will have their elbow raised beyond a natural position.

Additionally, a particular person may find that their chair is suitable for some tasks and work surfaces but not for others.

It would be desirable to have an armrest that could be adjusted laterally and pivotally to accommodate persons of different body widths, and also vertically to accommodate persons of different heights. Further, it would be advantageous if the means for accomplishing these adjustments were relatively simple so that they could be made by the persons who sit on the chairs rather than at the factory.

Still further, it would be advantageous if the identical arm would be suitable for use on both sides of the chair. This latter feature is particularly advantageous since only one mold and one assembly line would be required for both arms. Thus, there would be a substantial reduction in labor and materials and attendant costs over armrests which are specific for either the right side or the left side of the chair. This will result in a substantial cost savings to the consumer.

Accordingly, the invention comprises an armrest for a chair which can be moved laterally so that the chair can accommodate people of different body widths.

In another aspect, the invention relates to an armrest assembly to be connected to a chair. The armrest assembly can be pivoted through a plurality of locations in a plane that is generally parallel to the seat of the chair so that it can be positioned to support the forearm of the person sitting.

In still another aspect, the invention relates to an armrest assembly for a chair which can be raised and lowered through a plurality of locations relative to the seat of the chair to accommodate both tall and short people since their elbows are respectively further from and closer to the seat.

In still a further aspect, the invention relates to an adjustable chair for people of different body widths comprising a seat, an elongated member and an armrest assembly. The elongated member includes means for connecting the armrest assembly to the chair so that it can move laterally of the seat. Additionally, means are provided for pivoting the armrest assemblies in a plane parallel to the plane of the seat so that the armrest assemblies can be adjusted as the distance between them is increased or decreased.

DETAILED DESCRIPTION OF THE INVENTION

Figure 1:
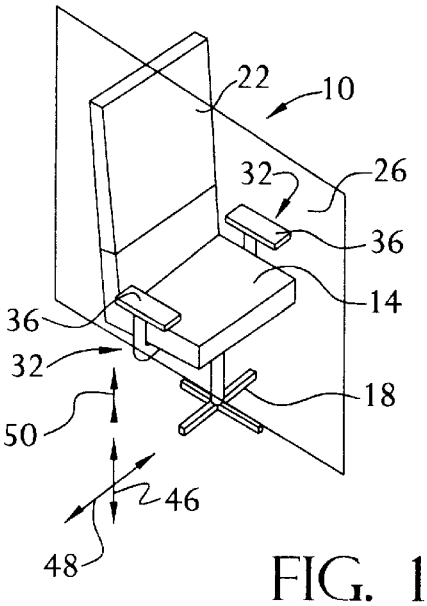
FIG. 1 is a perspective view of a chair on which a presently preferred form of the invention is mounted.

The invention can best be understood by referring to the accompanying drawings where in FIG. 1 a typical office chair 10 which comprises a seat 14, a pedestal 16 and a back 22 is illustrated. The chair defines a vertically extending center plane 26 about which the chair may be symmetrical.

The chair 10 includes two identical arms 32 which are constructed in accordance with a presently preferred form of the invention.

Each arm 32 includes an armrest assembly 36 which is supported on the chair for vertical movement in the directions of double headed arrow 46, lateral movement in the directions of double headed arrow 48, and for pivotal movement around an axis defined by pivot arrow 50.

As explained earlier, both armrests are identical and as will be more fully understood are interchangeable.

The armrests are laterally adjustable in the direction of double arrow 48 to accommodate persons of different body widths or particular tasks. As is well understood, for some tasks or when a relatively slim person is seated, the armrests can be moved toward to each other in the direction of double arrow 48 to be comfortably close to the person's body and pivoted about pivot axis 50 so that they are substantially parallel to center plane 26 to support the persons forearms.

On the other hand, for other tasks or when a person whose body is relatively wide is seated, the armrests are moved away from each other in the direction of double arrow 40 to increase the width between them. Additionally, the armrest assemblies 36 are pivoted about pivot axis 50 in the direction which would form a right angle with the center plane 26. However, the degree of pivot need only be so far as to place the armrest assemblies 36 directly under the person's forearms.

Figure 2A:
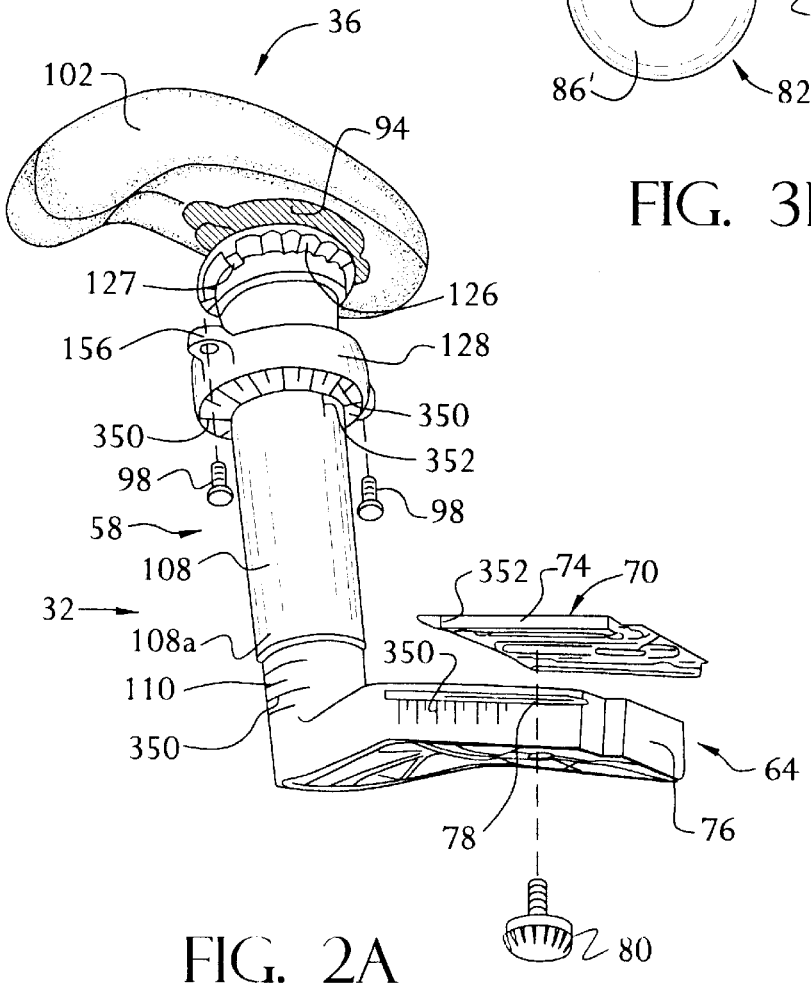
FIG. 2A is a partially exploded perspective view of a presently preferred form of the invention.

In FIG. 2A arm 32 is seen to comprise an elongated member 58 having a laterally extending arm assembly 64 at its lower end and the armrest assembly 36 at its upper end.

Figure 2B:
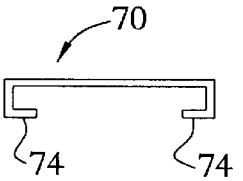
FIG. 2B is an elevation view of a portion of the device shown in FIG. 2A.

The laterally extending arm assembly 64 may include a downwardly facing, channel-shaped adjustment and mounting plate 70, shown in FIGS. 2A and 2B which includes downwardly extending and inwardly directed legs 74.

Figure 3A:
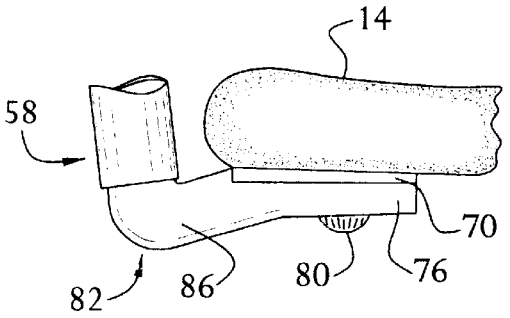
FIGS. 3A and 3B show the relationship between a chair and presently preferred forms of the invention which show how the invention accomplished one of its purposes.
Figure 3B:
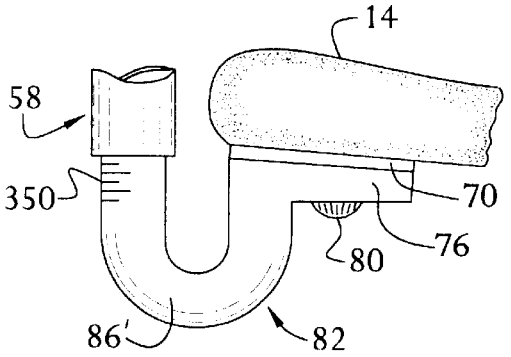

The laterally extending arm assembly includes a lateral element 76 which includes suitable elongated grooves 78 on its outer surfaces for sliding engagement with the downwardly extending and inwardly directed legs 74 on the adjustment and mounting plate 70. As seen in FIGS. 3A and 3B adjustment and mounting plate 70 is connected to the underside of the seat 14 on each side of the chair 10.

The lateral elements 76 slide relative to their respective mounting and adjustment plates 70 in the direction of lateral movement arrow 48 to a convenient and comfortable distance from each other. Suitable fasteners 80 such as screws with large heads that can be easily grasped can be used to secure the lateral element 76 to respective mounting and adjustment plates 70 in any convenient lateral position.

As seen in FIG. 3A, the juncture 82 of lateral element 76 and the elongated member 58 is below the height of the seat cushion when a person is sitting in the chair for a reason which will be explained. A suitable structure for accomplishing this result is the downwardly directed segment 86 of the lateral element 74. However, any other suitable structure can be used if it accomplishes the same purpose. Thus, for aesthetic reasons it may be desirable to have the juncture shaped like a "J", as illustrated at 86' in FIG. 3B.

Figure 4:
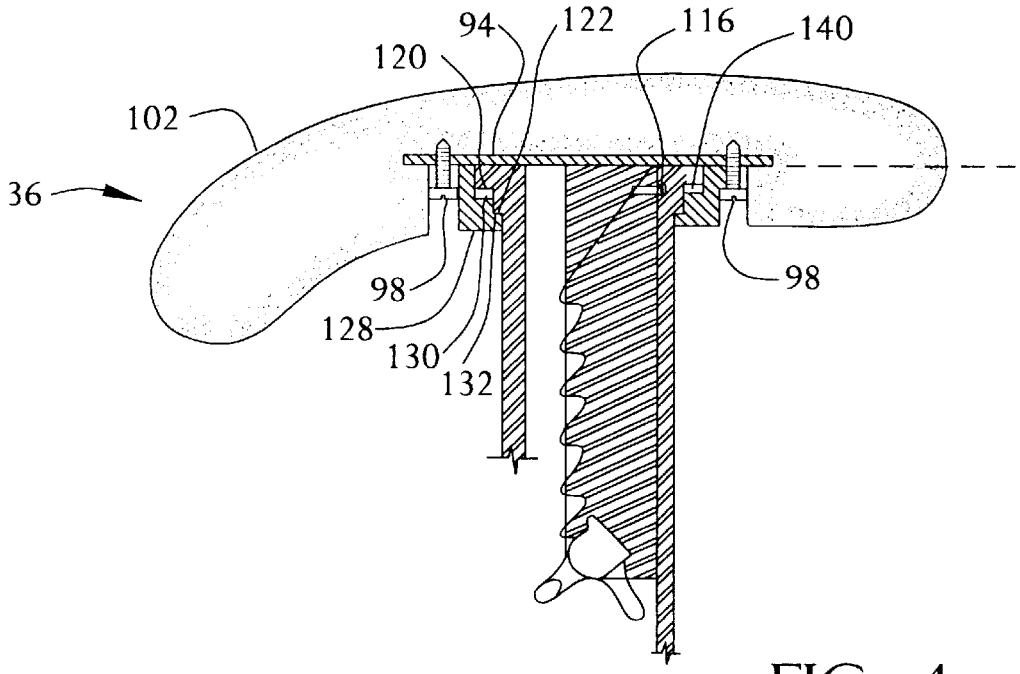
FIG. 4 is an elevation view, partially in section, of a portion of the device shown in FIG. 2A.
Figure 5:
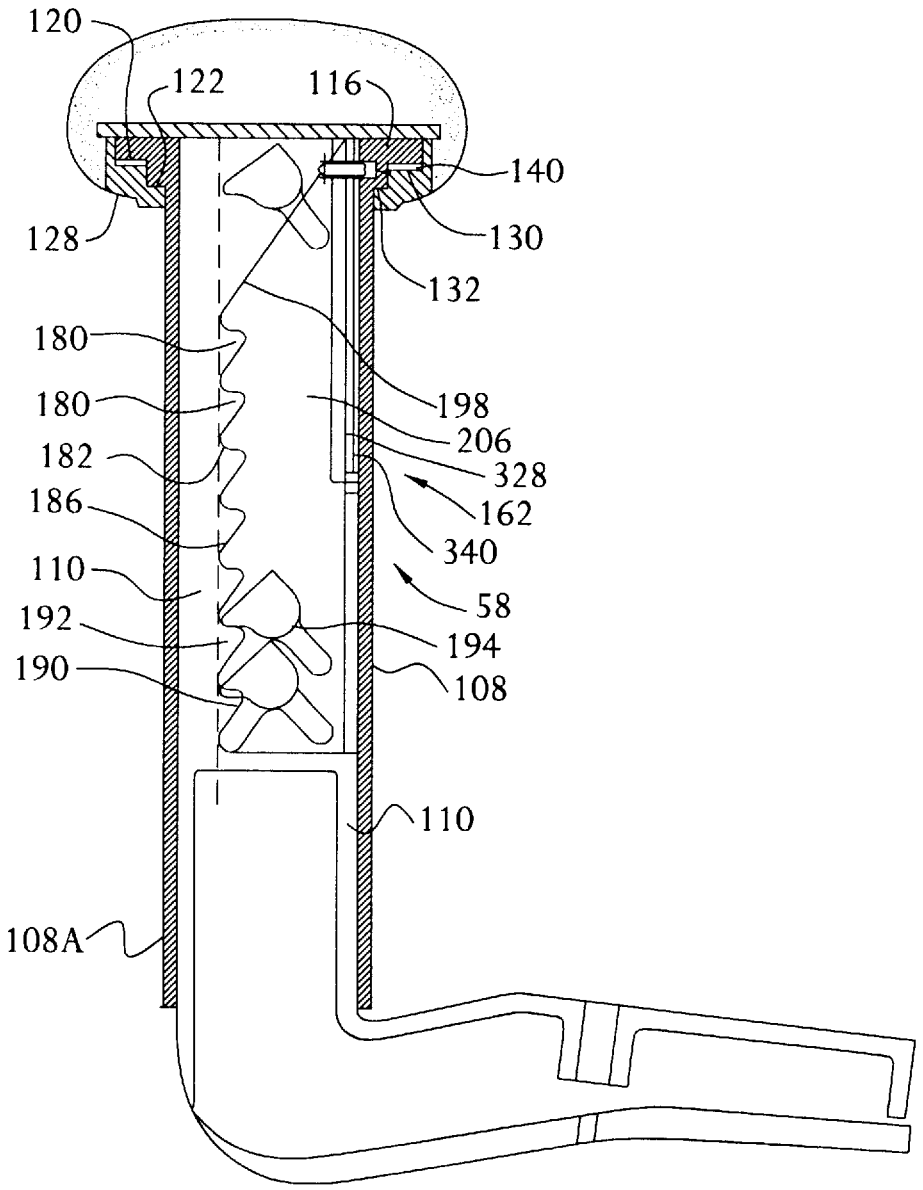
FIG. 5 is an elevation view, partially in section, of a portion of the device shown in FIG. 2A.

As seen in FIGS. 2A, 4 and 5, the armrest assembly 36 comprises a horizontally disposed plate 94 which may be connected by suitable fasteners such as screws 98 to an armrest pad 102. As will be more fully explained, the armrest assembly 36 is rotatable about pivot axis 50 which extends through elongated member 58.

As best seen in FIGS. 2–6, elongated member 58 comprises a first hollow elongated member 108 and a second elongated member 110. The second elongated member 110 extends upwardly from juncture 86 and is telescopically received within the first hollow elongated member 108.

As best seen in FIGS. 4 and 5, the first elongated member 108 includes at its upper end an outwardly directed and radially extending flange 116 which defines first and second downwardly facing and radially offset ledges 120 and 122. As seen in FIG. 2, downwardly facing ledge 120 includes a plurality of circumferentially arranged detents 126 which are defined by a plurality of circumferentially arranged undulations forming "V" or "U"-shaped depressions in the downwardly facing ledge 120.

Suitable downwardly extending stop elements 127 may be supported by ledge 120 for limiting the pivotal movement of the armrest assembly 36.

Figure 7A:
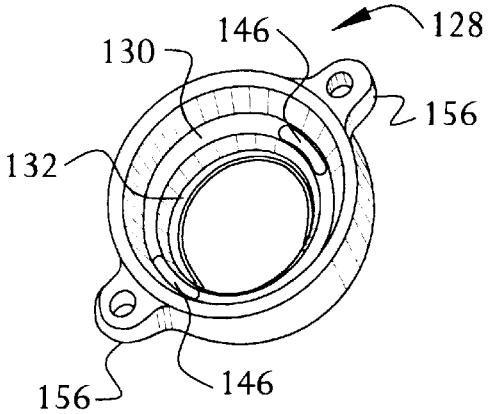
FIGS. 7A and 7B are perspective and elevation views respectively of a portion of the device shown in FIG. 2A.

The armrest assembly 36 is connected to first elongated member 108 by a collar 128 shown best in FIGS. 4, 5 and 7A. The collar 128 includes upwardly facing and radially inwardly extending ledges 130 and 132.

Figure 7B:
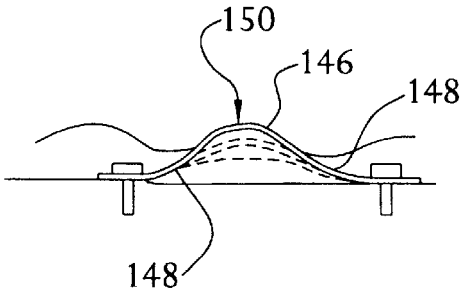

As seen in FIGS. 4 and 5, upwardly facing ledge 132 bears against and is in supporting engagement with downwardly facing ledge 122 on flange 116. Downwardly facing ledge 120 on flange 116 overlies and is coextensive with upwardly facing ledge 130 on collar 128. However, a small gap 140 is provided between the two ledges. The gap provides a space in which bow-shaped springs 146 (FIG. 7B) whose legs 148 are connected to ledge 130 are located. The bow 150 of each bow-shaped spring 146 is in yielding and sliding engagement with the detents 126 on ledge 120.

The collar 128 includes two diametrically opposed and laterally extending ears 156 for receiving the aforementioned screws 98 for connecting the collar 128 to the horizontally disposed plate 94 for the armrest assembly 36. Thus, it can be seen that the just-described mechanism permits the armrest assembly 36 to pivot about first member 108 and pivot axis 50. The engagement of the detents 126 on ledge 120 by the bow-shaped springs 146 on upwardly facing ledge 130 releasably retain the armrest assemblies 36 in the position to which they are moved.

Thus, the armrest assemblies can be pivoted about pivot axis 50 in a plane which is generally parallel to the plane of the seat 14.

Since the stops 127 extend almost to engagement with upwardly facing ledge 130, they limit the rotation of the armrest assembles when they engage the bow-shaped springs 146 since there is insufficient room in the gap 140 for them to pass.

Figure 6:
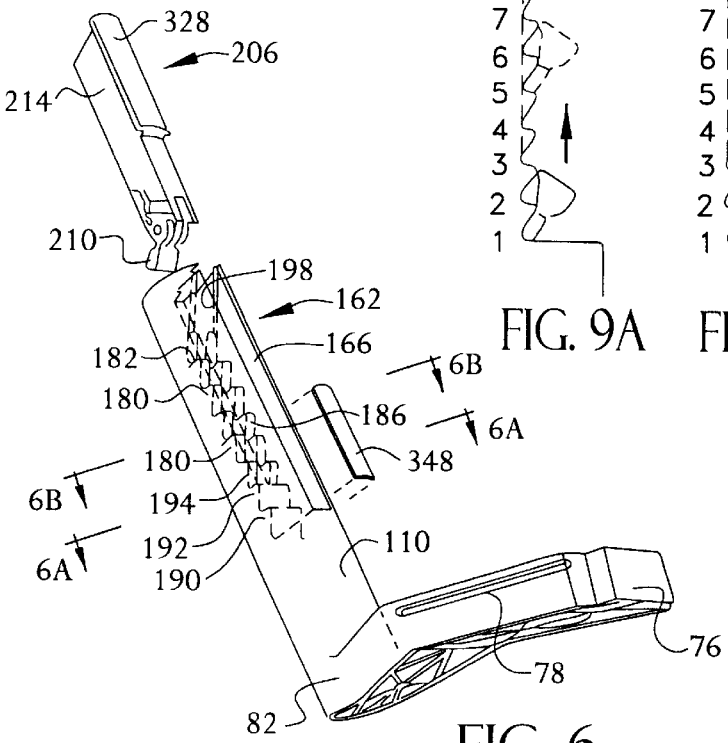
FIG. 6 is an exploded perspective view of an interior portion of the device shown in FIG. 2A.
Figure 8B:
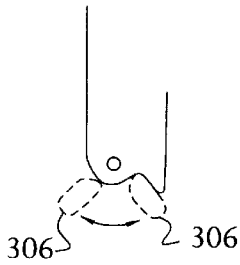
FIG. 8B is a view showing the range of movement of one of the elements shown in FIG. 8A.
Figure 8A:
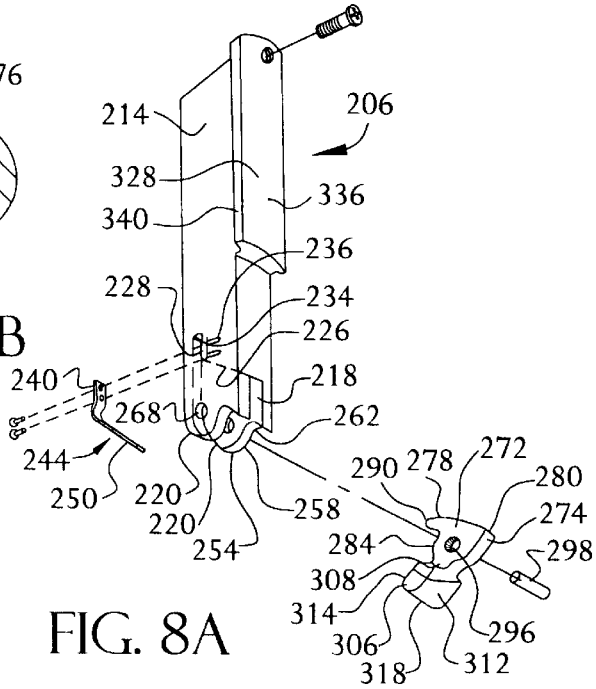
FIG. 8A is an exploded perspective view of a portion of the device shown in FIG. 6.

Complementary and mutually engageable elements comprising a ratchet mechanism 162 seen in FIGS. 5, 6 and 8 are connected to said first and second elongated members 108 and 110 for enabling the armrest assembly 36 to move upwardly and downwardly relative to the seat 14 and to be placed at a predetermined location.

Figure 6A:
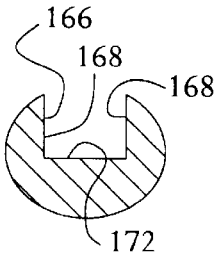
FIGS. 6A and 6B are section views taken along lines 6A—6A and lines 6B—6B of FIG. 6.
Figure 6B:
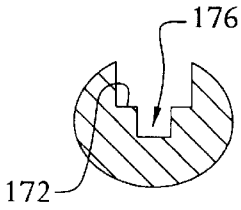

The ratchet mechanism 162 comprises a first relatively wide and radially directed groove 166 which extends longitudinally in second elongated member 110 from its upper end to near juncture 82. Groove 166 includes sidewalls 168 and bottom wall 172 as seen in FIG. 6A. A relatively wide and radially directed second groove 176 in the bottom wall 172 of groove 166 also extends longitudinally in second elongated member 110 as seen in FIG. 6B.

A plurality of ratchet teeth 180 in groove 166 extend between sidewalls 168. Each ratchet tooth 180 includes an upwardly facing ratchet step 182 and a downwardly angled surface 186.

The second groove 176 defines a slot in each of the ratchet teeth 180. However, the second groove 176 does not pass through the last ratchet tooth 190 or the ratchet tooth 192 adjacent to it. Since the ratchet step 182 in ratchet tooth 192 does not include a notch, it serves as an engagement camming surface 194 as will be more fully explained.

At the upper end of the second elongated member 110, disengagement camming surfaces 198 in the form of elongated slopes which extend substantially across the interior of the second elongated member are provided.

As seen in FIGS. 5, 6 and 8, a slider 206 which is connected to the first elongated member 108 for movement with it supports a pawl 210. The slider 206 includes an elongated rectangular body 214 that slides vertically in first groove 166 and is guided by side walls 168 and bottom wall 172. At its lower end, the slider 206 include a recess 218 defined by spaced parallel ears 220. The bottom of the recess 218 is defined by a sloping wall 226 which terminates at a longitudinal wall 228 that defines a notch 234.

In wall 228 are two screw holes 236 by which the leg 240 of flat spring 244 is connected to the slider 206. The leg 240 extends downwardly below sloping wall 226 and supports a blade 250 which extends downwardly at a slope which is spaced from and is generally parallel to sloping wall 226. Blade 250 is biased in a clockwise direction.

The lower end 254 of each ear 220 may be rounded with a reverse curving surface 258 defining a recess 262. Each ear 220 includes transversely disposed openings 268.

The pawl 210 is best seen in FIG. 8 as having a body 272 defined in part by front wall 276 which is generally disposed at a right angle to top wall 278. The juncture of front wall 276 and top wall 278 define a corner 280. Top wall 278 extends rearwardly and merges with rear wall 284. The juncture of top wall 278 and rear wall 284 forms a rearwardly extending tail 290. The body 272 includes a transversely extending opening 296 which cooperates with openings 220 in slider 206 and pin 298 to pivotally support the pawl 210. The body 272 is connected to blade 306 by laterally extending shoulders 308. The blade 306 includes a front wall 312 and a rear wall 312 which are connected by a rounded bottom wall 318.

The width of the body 272 is such that it can be received in the groove 176 in the bottom wall 166 of groove 166 while the greater with of the blade confines it so that it can only be received in the second groove 166.

The blade 250 of flat spring 244 is disposed between sloping wall 226 and pawl body 272 and cooperates with the pawl body 272 to form a toggle that retains the blade 306 in either a first clockwise position in which the blade 306 can engage the ratchet steps 182 and a second counter-clockwise position in which it is pivoted away from and is disengaged from the ratchet steps 182 as seen in FIG. 8B.

FIGS. 5, 6 and 8 show that the slider 206 includes an elongated cap 328 having a set screw opening 330. The cap 328 includes an arcuate upper surface 336 and laterally extending wings 340.

The slider 206 is connected to the first elongated member 108 by a screw 342 that extends through set screw opening 330 and flange 128. Thus, screw 342 connects the cap 328 to the slider body 214 while at the same time connecting the slider 206 to the first elongated member 108. The upper portion of the cap 328 defined by the arcuate surface 336 and wings 340 define a spacer which permits the body 214 to slide smoothly in slot 166 and to support the upper end of first elongated member 108.

A second cap 348 may be provided to close the lower portion of groove 166 so that it is not visible when the armrest assembly is raised.

The person using the chair can adjust it to precisely fit their body size, task or work surface by moving the armrests assemblies 36 inwardly or outwardly, pivoting them in a plane which is generally parallel to the seat of the chair and by raising or lowering them to a point where they are comfortable.

The armrest assemblies 36 are raised and lowered by the mechanism illustrated in FIGS. 5–10B.

Figures 9A, 9B, 9C:
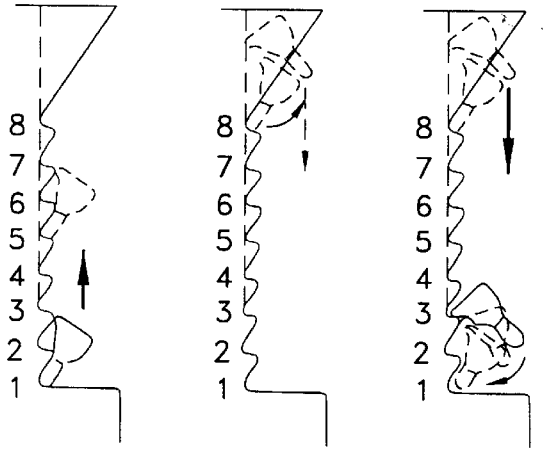
FIGS. 9A–9C show the mechanism for engaging and releasing the ratchet mechanism in the presently preferred form of the invention.
Figure 10A:
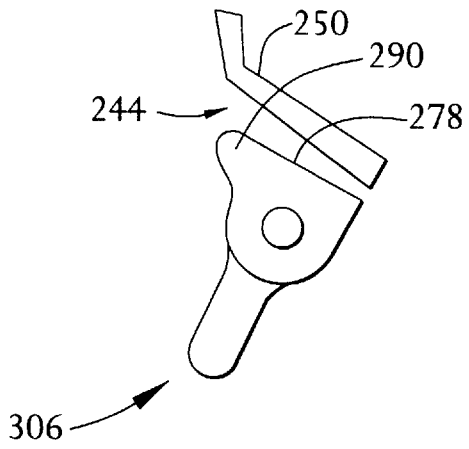
FIGS. 10A and 10B are partial elevation views showing aspects of the ratchet mechanism in the presently preferred form of the invention.
Figure 10B:
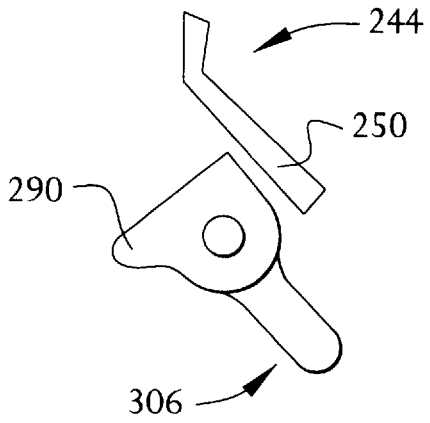

In FIG. 9A and 10A the armrest assembly 36 is in its lower-most position. In this position, the pawl 210 has been rotated clockwise against the force of leaf spring 244 by the engagement by tail 290 and the second from the last ratchet tooth 192. The pawl 210 is held in place by leaf spring 244 bearing against top wall 278. This occurs because the second groove 176 does not extend through that tooth. Accordingly, when the pawl moves downwardly, tail 290 passes through all of the ratchet teeth 180 until it engages ratchet tooth 192 which serves as an engagement camming surface 194. The pawl 210 is then toggled clockwise into the position illustrated where the blade 306 is directed toward the ratchet teeth 182.

When the armrest assembly 36 is raised it pulls first elongated member 108 and slider 206 with it. The armrest assembly 36 is constrained against rotation about pivot axis 50 because cap 328 is in engagement with the sidewalls of first groove 166. As the armrest assembly is raised the rear wall 314 of the blade 306 slides against the angled surfaces 186 on each of the ratchet teeth 180 until a suitable height is reached. When the armrest assembly is released it drops slightly until the blade 306 is nestled between two adjacent ratchet teeth; the lower one supporting it and preventing further downward movement.

The armrest assembly 36 can be easily raised to a higher position by simply pulling it up until that position is reached. To lower the armrest, it must first be raised to the fullest extent of its upward travel. At that point, the shoulders 308 at the juncture of the body 222 and 306 of the pawl 210 will engage the sloped disengagement camming surfaces 198 at the top of the second elongated member 110. Continued upward movement of the slider 206 causes the pawl to rotate counter-clockwise against the force of spring 244 until corner 280 at the juncture of front wall 276 and top wall 278 passes the blade 250 whereupon the spring 244 causes the pawl to toggle to the disengagement position illustrated in FIGS. 9B and 10B where the blade 306 is directed away from the ratchet teeth 180 and the blade 250 bears against the front wall 274 of the pawl body 272. With the pawl 210 in the disengagement position the armrest assembly can be easily lowered to the bottom of its travel whereupon the engagement of tail 290 and the second from the last ratchet tooth 192 will cause the blade 306 to toggle clockwise past corner 280 and into engagement with the ratchet teeth as seen in FIG. 9C.

The armrest assembly 36 can be lowered to almost the level of the seat 14 since the juncture 82 of the second elongated member 110 and lateral element 76 is below the level of the seat to receive the distal end 108A of elongated hollow member 108.

The lateral movement of the armrests and their pivotal movement cooperate to accommodate persons of different body widths or different tasks. The arms are moved laterally by sliding the lateral elements 76 in the adjustment and mounting plates 70 until a desired distance between the armrests is achieved. Then the armrests are secured against further movement plates 70 until a desired distance between the armrests is achieved. Then the armrests are secured against further movement by fastener 80. The lateral sliding movement is achieved because of the relationship between the downwardly and inwardly directed legs 74 and the grooves 78 in the lateral elements 76.

After the armrest assemblies 36 are correctly spaced, they are pivoted about pivot axis 50 until they lie parallel to the position that the person's forearms assume while they are working at their task. The pivoting of the armrest assemblies 36 is accomplished by the rotation of collar 128 relative to the first elongated member 108. As the collar 128 turns, the bow-shaped springs 146 on the first upwardly facing ledge 130 yieldably engage the detents 126 on the first downwardly facing ledge 120 on flange 116. The engagement of the detents 126 by the bow-shaped springs 146 prevents the armrest assemblies 36 from being inadvertently pivoted from the position in which they are set.

The armrests 36 can then be raised or lowered to suit the comfort and convenience of the person sitting in the chair.

Advantageously, scales 350 and indices 352 or other suitable markers or indicia could be placed on adjacent elements comprising the armrest that move relative to each other such as the adjustment and mounting plates 70 and the lateral elements 76; the second elongated member 110 and the bottom edge of the first elongated member 108; and the collar 128 and the top of the first elongated member 108. This will permit the relative positions of those elements to be noted and recorded so that if their relative positions are changed or if an armrest is being configured for the first time, the adjacent elements can be moved to their pre-noted relative positions thereby avoiding the need for adjustment by trial and error.

Thus, what has been described is an armrest assembly 36 for a chair which is fully adjustable to enable a particular chair to comfortably accommodate persons of different body types or to be used by a particular person for a variety of tasks and with work surfaces of different heights. This is because the armrest assembly is adjustable so that not only can it be moved closer or further from the center plane 26 of the chair, but also the armrests can be pivoted to a position where they are comfortable for the user while at the same time being raised or lowered as is convenient.

Additionally, it is apparent that a particular arm constructed in accordance with the invention can be used on either the left side or the right side of the chair as is desired. This is particularly advantageous since it is not necessary to provide separate equipment for making the left arm and the right arm.

Still further, since horizontally disposed plate 94 actually supports the collar 128 as part of a permanent installation, a plurality of different types of armrest pads 102 or other devices can be connected to the horizontally disposed plate 136 by the screws 98 or by other suitable fasteners either by the person using the chair or by the manufacturer.

Accordingly, pads having therapeutic advantages, a desk surface, a tray or any other suitable item which can advantageously be used by the person sitting in the chair could be mounted on the horizontally disposed plate 94 as desired.

Thus, while the invention has been described with regard to particular embodiments, it is apparent that other forms and embodiments will be obvious to those skilled in the art in light of the foregoing description. Thus, the scope of the invention should not be limited by that description, but rather, only by the scope of the appended claims.

I claim:

1. An armrest assembly for connection to a chair which armrest assembly can pivot through a plurality of locations in a plane that is generally parallel to the seat of the chair, comprising a first member, said first member being for connection to said chair, an armrest assembly, said armrest assembly being supported by said first member, means connected to said armrest assembly and to said first member for enabling said armrest assembly to pivot relative to said first member in a plane that is generally parallel to the seat of said chair, said means connected to said armrest assembly comprises a plurality of circumferentially disposed detents and a yieldable means, each of said detents corresponding to one of said locations of said armrest assembly in said plane, and said yieldable means is selectively engagable with at least one of said detents for releasably retaining said armrest assembly in one of said locations, a collar, said collar being disposed around said first members, said collar being movable relative to said first member with said armrest assembly, said collar including means for connecting it to said armrest assembly so that it is movable with said armrest assembly relative to said first member through a range of movement, and said detents and said yieldable means are connected to said armrest assembly and said collar.

2. The armrest assembly as defined in claim 1 wherein said first member includes a radially outwardly directed flange, said flange including at least one surface disposed in said plane, means for connecting said flange to said armrest assembly, said collar including a surface that is disposed in said plane, said surfaces of said flange and said collar being juxtaposed in overlapping relation to each other, and detents and said yieldable means are connected to said juxtaposed surface so that the armrest assembly can be selectively pivoted in said plane.

3. The armrest assembly as defined in claim 1 wherein said yieldable means comprises at least one spring.

4. The armrest assembly as defined in claim 1 including means for limiting the range of movement of said armrest assembly in said plane.

5. An armrest assembly for connection to a chair which armrest assembly can pivot through a plurality of locations in a plane that is generally parallel to the seat of the chair, comprising a first member, said first member being for connection to said chair, an armrest assembly, said armrest assembly being supported by said first member, means connected to said armrest assembly and to said first member for enabling said armrest assembly to pivot relative to said first member in a plane that is generally parallel to the seat of said chair, said means connected to said armrest assembly comprises a plurality of circumferentially disposed detents and a yieldable means, each of said detents corresponding to one of said locations of said armrest assembly in said plane, and said yieldable means is selectively engagable with at least one of said detents for releasably retaining said armrest assembly in one of said locations, said first member including a radially outwardly directed flange, said flange including an outwardly directed and downwardly facing surface, a collar, said collar including an inwardly directed and upwardly facing surface, said plurality of circumferentially disposed detents being disposed on one of said surfaces and said yieldable means being disposed on the other surface, and said collar is operative to connect said first member to said armrest assembly.

6. An armrest assembly as defined in claim 5 wherein said yieldable means are disposed on said collar.

7. An armrest assembly as defined in claim 5 wherein said detents are disposed on said flange.

8. An armrest assembly as defined in claim 5 wherein said armrest assembly includes a pad and a connector, and means for releasably connecting said connector to said collar.

9. An armrest assembly for connection to a chair which armrest assembly can pivot through a plurality of locations in a plane that is generally parallel to the seat of the chair, comprising a first member, said first member being round in cross-section and being for connection to said chair, an armrest assembly, said armrest assembly being supported by said first member, means connected to said armrest assembly and to said first member for enabling said armrest assembly to pivot relative to said first member in a plane that is generally parallel to the seat of said chair, said means connected to said armrest assembly comprises a plurality of circumferentially disposed detents and a yieldable means, each of said detents corresponding to one of said locations of said armrest assembly in said plane, and said yieldable means is selectively engagable with at least one of said detents for releasably retaining said armrest assembly in one of said locations, said first member includes a radially outwardly directed flange, said flange including an outwardly directed and downwardly facing surface, a collar, said collar including an inwardly directed and upwardly facing surface, said plurality of circumferentially disposed detents being disposed on one of said surfaces and said yieldable means being disposed on the other surface, and said collar is operative to connect said first member to said armrest assembly.

10. An armrest assembly for connection to a chair having a seat which armrest assembly can be raised and lowered through a plurality of locations relative to the seat of the chair to accommodate both tall and short people because their elbows are usually respectively further from and closer to the seat, comprising an armrest assembly, a first substantially hollow elongated member, said first elongated member having a lower distal end and being for connection to said armrest assembly, a second elongated member, said second elongated member being for connection to said chair, said second elongated member being in sliding telescopic relation with said first elongated member and said first elongated member overlying said second elongated member, said first elongated member being movable relative to said second elongated member through a predetermined range of movement so that for a tall person said armrest assembly is in a raised position and for a short person said armrest assembly is in a lower position, said second elongated member includes a laterally extending arm, said laterally extending arm including first and second parts, one of said parts being connectable to the underside of said seat, the other part of said laterally extending arm extending downwardly from the underside of said seat, said second elongated member and said other part of said laterally extending arm being connected to each other at a juncture, and said juncture of said second elongated member and said other part of said laterally extending arm being below the seat to receive said lower distal end of said first elongated member when the armrest assembly is lowered to accommodate a short person.

11. An armrest assembly as defined in claim 10 wherein said armrest assembly includes a pad and a connector, and means for releasably connecting said connector to said first elongated member.

12. An armrest assembly for connection to a chair having a seat which armrest assembly can be raised and lowered through a plurality of locations relative to the seat of the chair to accommodate both tall and short people because their elbows are usually respectively further from and closer to the seat, comprising an armrest assembly, a first elongated member, said first elongated member being for connection to said armrest assembly, a second elongated member, said second elongated member being for connection to said chair, said first and second elongated members being in sliding telescopic relation to each other through a predetermined range of movement so that for a tall person said armrest assembly is in a raised position and for a short person said armrest assembly is in a lower position, said second elongated member includes a laterally extending arm, for being connected to the underside of said seat, and the juncture of said second elongated member and said other part of said laterally extending arm being below the seat so that the armrest assembly can be lowered to accommodate a short person, lateral adjustment means for being connected between said laterally extending arm and the chair, said lateral adjustment means including means for connecting it to said chair, said lateral adjustment means including a downwardly facing generally channel shaped member having downwardly directed and inwardly facing legs, said laterally extending arm including means for engaging said downwardly directed and inwardly facing legs, said generally channel shaped member and said means for engaging said downwardly directed and inwardly facing legs constraining said armrest assembly for lateral translation movement relative to said seat to accommodate people with different body widths, and means for releasably connecting said lateral adjustment means and said laterally extending arm.

13. An armrest assembly for connection to a chair having a seat which armrest assembly can be raised and lowered through a plurality of locations relative to the seat of the chair to accommodate both tall and short people because their elbows are usually respectively further from and closer to the seat, comprising an armrest assembly, a first elongated member, said first elongated member being for connection to said armrest assembly, a second elongated member, said second elongated member being for connection to said chair, said first and second elongated members being in sliding telescopic relation to each other through a predetermined range of movement so that for a tall person said armrest assembly is in a raised position and for a short person said armrest assembly is in a lower position, complementary and mutually engagable ratchet elements supported by said first and second elongated members, said ratchet elements comprising a plurality of ratchet steps on one of said elongated members and a pawl pivotally connected to the other one of said elongated members for pivotal movement into and out of engagement with said ratchet steps, and means defining a toggle, said toggle including said pawl and yieldable means for urging said pawl to slide past said ratchet steps when said armrest assembly is being raised and for urging said pawl to engage at least one of said ratchet steps when said armrest assembly is being lowered to thereby permit said armrest assembly to be placed at one of said locations, said means defining a toggle further includes a disengagement camming surface and an engagement camming surface, said disengagement and engagement camming surfaces being spaced from each other with said ratchet steps being disposed between them, said disengagement camming surface being operative to engage said pawl and pivot it away from said ratchet teeth so that said armrest assembly can be lowered, and said engagement camming surface being operative to engage said pawl and pivot it toward said ratchet teeth to prevent said armrest assembly from being lowered.

14. An armrest assembly as defined in claim 13 wherein said armrest assembly includes a pad and a connector, and means for releasably connecting said connector to said first elongated member.

15. An armrest assembly for connection to a chair having a seat which armrest assembly can be raised and lowered through a plurality of locations relative to the seat of the chair to accommodate both tall and short people because their elbows are usually respectively further from and closer to the seat, comprising an armrest assembly, a first elongated member, said first elongated member being for connection to said armrest assembly, a second elongated member, said second elongated member being for connection to said chair, said first and second elongated members being in sliding telescopic relation to each other through a predetermined range of movement so that for a tall person said armrest assembly is in a raised position and for a short person said armrest assembly is in a lower position, complementary and mutually engagable ratchet elements supported by said first and second elongated members, said ratchet elements comprising a plurality of ratchet steps on one of said elongated members and a bawl pivotally connected to the other one of said elongated members for pivotal movement into and out of engagement with said ratchet steps, and means defining a toggle, said toggle including said pawl and yieldable means for urging said pawl to slide past said ratchet steps when said armrest assembly is being raised and for urging said pawl to engage at least one of said ratchet steps when said armrest assembly is being lowered to thereby permit said armrest assembly to be placed at one of said locations, means defining upper and lower limits for raising and lowering said armrest assembly, said engagement camming surface being operative when said armrest is at said lower limit, and said disengagement camming surface being operative when said armrest assembly is at its upper limit.

16. An armrest assembly for connection to a chair having a seat which armrest assembly can be raised and lowered through a plurality of locations relative to the seat of the chair to accommodate both tall and short people because their elbows are usually respectively further from and closer to the seat, comprising an armrest assembly, a first elongated member, said first elongated member being for connection to said armrest assembly, a second elongated member, said second elongated member being for connection to said chair, said first and second elongated members being in sliding telescopic relation to each other through a predetermined range of movement so that for a tall person said armrest assembly is in a raised position and for a short person said armrest assembly is in a lower position, complementary and mutually engagable ratchet elements supported by said first and second elongated members, said ratchet elements comprising a plurality of ratchet steps on one of said elongated members and a pawl pivotally connected to the other one of said elongated members for pivotal movement into and out of engagement with said ratchet steps, and means defining a toggle said toggle including said pawl and yieldable means for urging said pawl to slide past said ratchet steps when said armrest assembly is being raised and for urging said pawl to engage at least one of said ratchet steps when said armrest assembly is being lowered to thereby permit said armrest assembly to be placed at one of said locations, said second elongated member includes said ratchet steps, said first elongated member includes said pawl and said yieldable means, each of said ratchet steps extending transversely of said second elongated member and adjacent ones of said ratchet steps being disposed along said second elongated member, said ratchet steps including a last ratchet step, a groove in all of said ratchet steps except said last ratchet step, said pawl being pivotable around a transverse axis and including a first portion for engaging said ratchet steps and a second portion for causing said pawl to pivot, and said second portion is disposed in said groove so that it does not engage said ratchet steps and said pawl does not pivot until said second portion engages said last ratchet step where said pawl is pivoted into engagement with said ratchet teeth.

17. An armrest assembly as defined in claim 16 wherein said armrest assembly includes a pad and a connector, and means for releasably connecting said connector to said first elongated member.

18. An armrest assembly for connection to a chair having a seat which armrest assembly can be raised and lowered through a plurality of locations relative to the seat of the chair to accommodate both tall and short people because their elbows are usually respectively further from and closer to the seat, comprising an armrest assembly, a first elongated member, said first elongated member being for connection to said armrest assembly, a second elongated member, said second elongated member being for connection to said chair, said first and second elongated members being in sliding telescopic relation to each other through a predetermined range of movement so that for a tall person said armrest assembly is in a raised position and for a short person said armrest assembly is in a lower position, complementary and mutually engagable ratchet elements supported by said first and second elongated members, said ratchet elements comprising a plurality of ratchet steps on one of said elongated members and a pawl pivotally connected to the other one of said elongated members for pivotal movement into and out of engagement with said ratchet steps, and means defining a toggle, said toggle including said pawl and yieldable means for urging said pawl to slide past said ratchet steps when said armrest assembly is being raised and for urging said pawl to engage at least one of said ratchet steps when said armrest assembly is being lowered to thereby permit said armrest assembly to be placed at one of said locations, said second elongated member includes said ratchet steps, said first elongated member includes said pawl and said yieldable means, each of said ratchet steps extending transversely of said second elongated member and adjacent ones of said ratchet steps being disposed along said elongated member, a disengagement camming surface adjacent said ratchet steps, a groove in at least one of said ratchet steps and said camming surface, said pawl being pivotable around a transverse axis and including a first portion for engaging said ratchet steps and a second portion that is disposed in said groove, said first and second portions being connected by a shoulder, and said pawl does not pivot until said shoulder engages said disengagement camming surface where said pawl is pivoted out of engagement with said ratchet teeth.

19. An armrest assembly as defined in claims 18 wherein said armrest assembly includes a pad and a connector, and means for releasably connecting said connector to said first elongated member.

20. An armrest assembly for connection to a chair having a seat which armrest assembly can be raised and lowered through a plurality of locations relative to the seat of the chair to accommodate both tall and short people because their elbows are usually respectively further from and closer to the seat, comprising an armrest assembly, a first elongated member, said first elongated member being for connection to said armrest assembly, a second elongated member, said second elongated member being for connection to said chair, said first and second elongated members being in sliding telescopic relation to each other through a predetermined range of movement so that for a tall person said armrest assembly is in a raised position and for a short person said armrest assembly is in a lower position, complementary and mutually engagable ratchet elements supported by said first and second elongated members, said ratchet elements comprising a plurality of ratchet steps on one of said elongated members and a pawl pivotally connected to the other one of said elongated members for pivotal movement into and out of engagement with said ratchet steps, and means defining a toggle, said toggle including said pawl and yieldable means for urging said pawl to slide past said ratchet steps when said armrest assembly is being raised and for urging said pawl to engage at least one of said ratchet steps when said armrest assembly is being lowered to thereby permit said armrest assembly to be placed at one of said locations, said second elongated member includes said ratchet steps, a disengagement camming surface and an engagement camming surface, said ratchet steps being disposed on said second elongated member between said disengagement and engagement camming surfaces, said ratchet steps and said disengagement camming surfaces defining a groove in said second elongated member, a pawl support, said pawl support being connected to said first elongated member for movement with it and being disposed in said groove for sliding movement relative to said second elongated member, said pawl support including means for supporting said pawl for pivotal movement about a transverse axis, said pawl including a first portion which is wider than said groove and a second potion which is received in said groove, said first and second portions being connected by a shoulder, said pawl being pivoted out of engagement with said ratchet teeth when said shoulder engages said disengagement camming surface, and said pawl being pivoted into engagement with said ratchet teeth when said second portion engages said engagement camming surface.

21. An armrest assembly as defined in claim 20 wherein said ratchet steps include a last ratchet step, said groove does not extend through said last ratchet step, and said last ratchet step defines said engagement camming surface.

22. An armrest assembly as defined in claims 20 wherein said armrest assembly includes a pad and a connector, and means for releasably connecting said connector to said first elongated member.

23. An adjustable chair for people of different body widths comprising a seat, an elongated member and an armrest assembly, said seat including a front to rear center plane, said elongated member having upper and lower portions, said upper portion being for connection to said armrest assembly, said lower portion being for connection to said chair, means connected to said lower portion for selectively moving said armrest assembly laterally of said chair, means connected to said armrest assembly and to said upper portion of said elongated member for enabling said armrest assembly to selectively move by pivoting to a plurality of locations in a plane that is generally parellel to the seat of said chair, and said means connected to said lower portion and said means connected to said armrest assembly cooperate by enabling the angular relationship between said armrest assembly and said center plane to be selectively moved between a substantially parellel relation for a relatively slim person when said elongated member is close to said seat and a substantially right angle for a relatively wide person when said elongated member is located away from said seat so that said armrest assembly can supported the arms of both types of people, and said adjacent ones of said selectively moveable means include indicia for identifying their positions relative to each other.

* * * * *